US005082385A

United States Patent [19]

Stewart et al.

[11] Patent Number: 5,082,385

[45] Date of Patent: Jan. 21, 1992

[54] BALLPOINT FEATHER PEN

[76] Inventors: Prince Stewart, 1270 Graymont Dr. SW., Atlanta, Ga. 30310; George Spector, 233 Broadway RM 3815, New York, N.Y. 10007

[21] Appl. No.: 586,282

[22] Filed: Sep. 21, 1990

[51] Int. Cl.[5] ..... A45D 40/20; B43K 23/00

[52] U.S. Cl. ..... 401/88; 401/8; D19/42

[58] Field of Search ..... 15/435–444; 401/88, 8, 131; 281/44, 30; D19/42

[56] References Cited

U.S. PATENT DOCUMENTS

| | | | |
|---|---|---|---|
| D. 19,456 | 12/1889 | Brossy | D19/42 |
| D. 162,522 | 3/1951 | Currence | D19/42 |
| D. 168,531 | 1/1953 | Brudny | D19/42 |
| 341,350 | 5/1886 | Rogers | 401/8 |
| 781,556 | 1/1905 | Scharrath | 401/8 |
| 1,009,307 | 11/1911 | Hildebrand | 24/3 R |
| 4,257,713 | 3/1981 | Sherman | 401/88 |

*Primary Examiner*—Danton D. DeMille
*Assistant Examiner*—Richard Johnson

[57] ABSTRACT

A ballpoint feather pen is provided and consists of a feather to be gripped by a hand and a ballpoint pen dispenser carried in the bottom of the feather, so that the ballpoint pen dispenser within the feather can be used for writing.

1 Claim, 1 Drawing Sheet

BALLPOINT FEATHER PEN

BACKGROUND OF THE INVENTION

The instant invention relates generally to writing instruments and more specifically it relates to a ballpoint feather pen which provides the best combination of a quill pen and a ballpoint pen together.

There are available various conventional writing instruments which do not provide the novel improvements of the invention herein disclosed.

SUMMARY OF THE INVENTION

A primary object of the present invention is to provide a ballpoint feather pen that will overcome the shortcomings of the prior art devices.

Another object is to provide a ballpoint feather pen in which the ink cartridge of a ballpoint pen dispenser is inserted within the quill of a feather to combine the best features of a quill pen and a ballpoint pen together.

An additional object is to provide a ballpoint feather pen that has a finger grip clamp mounted onto the quill to better hold the ink cartridge of the ballpoint pen dispenser therein and allow for a better grip of the ballpoint feather pen.

A further object is to provide a ballpoint feather pen that is simple and easy to use.

A still further object is to provide a ballpoint feather pen that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
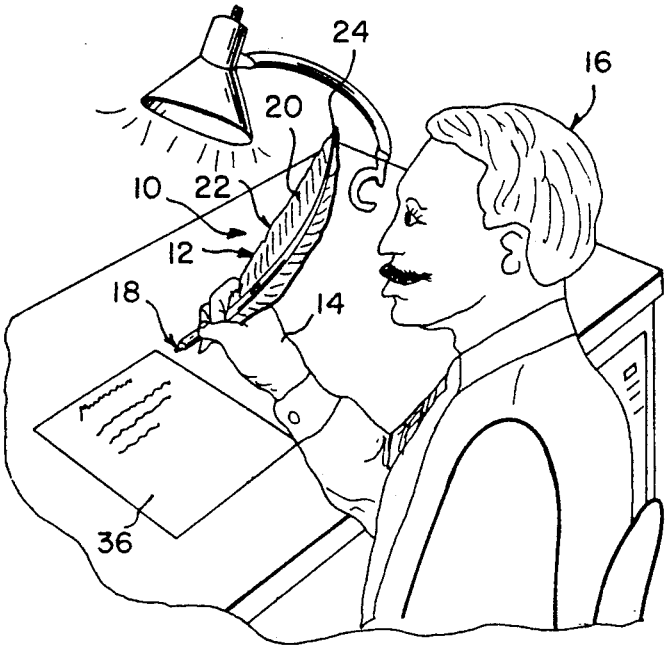
FIG. 1 is a perspective view of a person using the instant invention.
Figure 2:
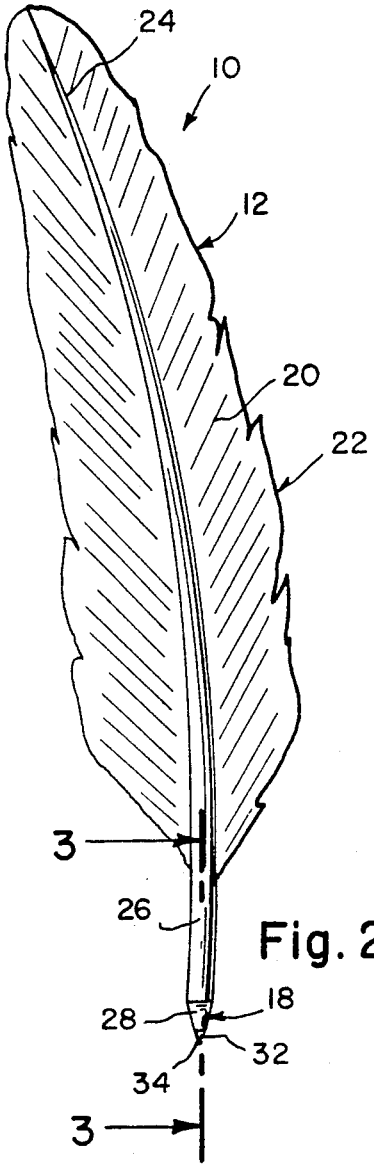
FIG. 2 is an elevational view of the instant invention.
Figure 3:
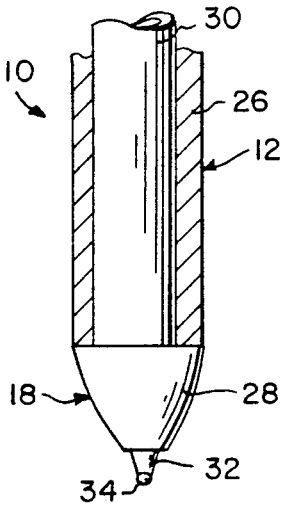
FIG. 3 is a cross sectional view taken along line 3—3 in FIG. 2, showing the ink cartridge of the ballpoint pen dispenser inserted within the quill of the feather.

Turning now descriptively to the drawings, in which similar reference characters denote similar elements throughout the several views, FIGS. 1 through 3 illustrate a ballpoint feather pen 10 consisting of a feather 12 large enough to be gripped comfortably by a hand 14 of a person 16. A ballpoint pen dispenser is 18 carried in the bottom of the feather 12, so that the combination of the ballpoint pen dispenser 18 and the feather 12 can be used by the person 16 for writing.

The feather 12 includes numerous slender, closely arranged parallel barbs 20 forming a vane 22 on either side of a tapering hollow shaft 24 that terminates into a quill 26 which is a hollow, stemlike main shaft of the feather 12.

The ballpoint pen dispenser 18 includes a head 28 with an ink cartridge 30 and a writing point 32 carrying a small ballbearing 34 therein. When the ink cartridge 30 is inserted within the quill 26 of the feather 12, the small ballbearing 34 in the writing point 32 will transfer ink stored in the ink cartridge 30 onto a writing surface 36 such as a piece of paper or the like.

Figure 4:
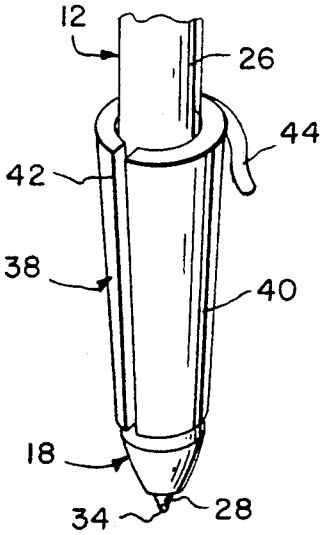
FIG. 4 is a perspective view of a finger grip clamp mounted onto the quill adjacent to the head of the ball point pen dispenser.

FIG. 4 shows a finger grip clamp 38 being a downwardly tapered contoured sleeve 40 having a longitudinal split 42 on one side and a small clip 44 on an opposite side. The clamp 38 is mounted onto the quill 26 of the feather 12 adjacent to the head 28 of the ballpoint pen dispenser 18 to better hold the ink cartridge 30 within the quill 26 and allows for a better grip of the ballpoint feather pen 10, while the clip 44 can be used for attachment to a garment.

The ballpoint feather pen 10 can come in different sizes and assorted colors. The feather 12 can be real from one of the light, horny structures forming the plumage of birds, or be made artificially from durable plastic material.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A ballpoint feather pen comprising:

a) a feather large enough to be gripped comfortably by a hand of a person; and b) a ballpoint pen dispenser carried in the bottom of said feather, so that the combination of said ballpoint pen dispenser and said feather can be used by the person for writing; wherein said feather includes a tapering hollow shaft that terminates at one end into a quill which is a hollow, stemlike main shaft of said feather; wherein said ballpoint pen dispenser includes a head with an ink cartridge extending from the head, said ink cartridge extends with said hollow quill in surrounding relationship with the head of the dispenser abutting the other end of the quill and said head including a writing point carrying a small ballbearing therein, so that when the ink cartridge is mounted within said quill the small ballbearing in the writing point will transfer ink stored in the ink cartridge onto a writing surface; further including a finger grip clamp being a downwardly tapered contoured sleeve having a longitudinal split on one side and a small clip on an opposite side, whereby said clamp is mounted onto the quill of said feather adjacent to the head of said ballpoint pen dispenser to better hold the ink cartridge within the quill and allows for a better grip of said ballpoint feather pen, while the clip can be used for attachment to a garment.

* * * * *